US009915499B2

(12) United States Patent
Alford

(10) Patent No.: US 9,915,499 B2
(45) Date of Patent: Mar. 13, 2018

(54) SINGLE TO TWO POINT TACTICAL SLING

(71) Applicant: Savvy Sniper, LLC, Port Washington, OH (US)

(72) Inventor: Brian K. Alford, Port Washington, OH (US)

(73) Assignee: SAVVY SNIPER, LLC, Port Washtington, OH (US)

( * ) Notice: Subject to any disclaimer, the term of this patent is extended or adjusted under 35 U.S.C. 154(b) by 0 days.

(21) Appl. No.: 15/401,373

(22) Filed: Jan. 9, 2017

(65) Prior Publication Data

US 2017/0122700 A1 May 4, 2017

Related U.S. Application Data

(63) Continuation of application No. 13/020,327, filed on Feb. 3, 2011, now Pat. No. 9,557,138.

(60) Provisional application No. 61/301,323, filed on Feb. 4, 2010.

(51) Int. Cl.
*F41C 33/00* (2006.01)
*F41C 23/02* (2006.01)

(52) U.S. Cl.
CPC ..... *F41C 33/002* (2013.01); *F41C 23/02* (2013.01); *F41C 33/00* (2013.01)

(58) Field of Classification Search
CPC ..... F41C 33/002
USPC ..... 224/149, 150, 913; 42/85; D3/262
See application file for complete search history.

(56) References Cited

U.S. PATENT DOCUMENTS 1,323,701 A 12/1919 Lethern
2,812,123 A 11/1957 Girton
3,982,769 A 9/1976 Farland
4,511,070 A 4/1985 Hightower
5,082,155 A 1/1992 Salvador
5,246,154 A 9/1993 Adams et al.
5,282,558 A 2/1994 Martinez
5,379,726 A 1/1995 Mann
5,810,219 A 9/1998 Rosenfield
6,068,167 A 5/2000 Hopson
6,520,390 B2 2/2003 Verdugo et al.
6,681,973 B2 1/2004 Crumrine
6,932,254 B2 8/2005 Eliason
(Continued)

OTHER PUBLICATIONS

The 2P: A combat tactical sling system for the 21st century (http://www.redi-mag.com/index.php?=product_detail&p=23).
U.S. Appl. No. 15/257,259, filed Sep. 6, 2016 (pending).

*Primary Examiner* — Justin Larson

(74) *Attorney, Agent, or Firm* — Copper Legal Group, LLC

(57) ABSTRACT

Provided is a sling for coupling a weapon to a user of the weapon. The sling includes a strap, and a weapon connector that cooperates with a fastening feature provided to the weapon to releasably couple the weapon to the strap. A first connector is coupled to the strap, as is a second connector, which is coupled to a different portion of the strap. The second connector is separated from the first connector along the sling by at least a portion of the strap. The first and second connectors cooperate to establish a connection and form a loop that extends about a portion of the user of the weapon. The sling also includes a rapid sizing adjuster coupled to the strap. The rapid sizing adjuster is adjustable by the user of the weapon to quickly establish a desired length of the sling in a single motion while the sling is coupling the weapon to the user.

18 Claims, 5 Drawing Sheets

(56) References Cited

U.S. PATENT DOCUMENTS

| | | | | |
|---|---|---|---|---|
| 7,059,502 | B2 | 6/2006 | Johnson | |
| 7,069,624 | B2 | 7/2006 | Johnson | |
| 7,073,234 | B2 * | 7/2006 | Turpin | A44B 11/263 24/572.1 |
| D577,093 | S | 9/2008 | White et al. | |
| D634,390 | S * | 3/2011 | Shulman | D22/108 |
| 7,959,046 | B2 | 6/2011 | Burnsed, Jr. et al. | |
| 8,430,285 | B2 | 4/2013 | Burnsed, Jr. | |
| 8,733,601 | B2 | 5/2014 | Burnsed, Jr. | |
| 9,494,383 | B2 * | 11/2016 | Kharlampov | F41C 33/002 |
| 2002/0020724 | A1 | 2/2002 | Lindsey | |
| 2004/0188476 | A1 | 9/2004 | Johnson | |
| 2006/0011677 | A1 | 1/2006 | Burnsed, Jr. et al. | |
| 2007/0278262 | A1 | 12/2007 | Gallagher | |
| 2008/0217371 | A1 | 9/2008 | Wemmer | |
| 2011/0017788 | A1 | 1/2011 | Haley et al. | |
| 2011/0062194 | A1 * | 3/2011 | Esch | F41C 33/002 224/150 |
| 2013/0299531 | A1 | 11/2013 | Burnsed, Jr. et al. | |
| 2014/0203053 | A1 * | 7/2014 | Rivas-Schlanger | F41C 33/002 224/150 |
| 2015/0292834 | A1 * | 10/2015 | McCarthy | F41C 33/002 224/150 |
| 2015/0292835 | A1 * | 10/2015 | McCarthy | F16B 45/02 24/599.6 |

* cited by examiner

SINGLE TO TWO POINT TACTICAL SLING

BACKGROUND OF THE INVENTION

1. Field of the Invention

This application relates generally to a sling for coupling a weapon to a person and, more specifically, to a tactical sling that couples a firearm to a person and is adjustable between a single-point configuration and a multiple-point configuration.

2. Description of Related Art

Traditionally, slings for coupling a weapon such as a firearm to a person have been configured as either a two-point sling or a single-point sling. Traditional two-point slings have commonly included a length of material extending between a pair of fasteners. A first fastener at one end of the material cooperates with a forward portion of the firearm, adjacent to a barrel of the firearm for example. A second fastener at the other end of the material, opposite the end with the first fastener, includes a second fastener that cooperates with a rearward portion of the firearm, such as the stock. With the two fasteners at opposite ends of the material cooperating with the firearm, the length of material could be draped over the person's shoulder, neck, or other body part to suspend the firearm from that person.

Traditional two-point slings allow the firearm suspended from the person to be quickly removed, and allow for a wide range of movement of the firearm on the person. Two-point slings also maintain the firearm at an elevation above the person's legs, allowing the person wearing the sling to walk or even run without kicking the firearm. However, two-point slings also typically suspend the firearm only in a substantially-horizontal orientation, which may be undesirable for certain tactical situations requiring the person to navigate narrow spaces with a long firearm.

As the name suggests, traditional single-point slings have commonly included only a single fastener that connects the firearm to the sling at a single location on the firearm at any given time. The length of material attached to the single fastener of a single-point sling typically forms a loop that extends around the upper torso (usually over one shoulder and under the other) of a person wearing the sling. Since the single-point sling is attached to the firearm at only a single location, the firearm is allowed to dangle in a substantially-vertical orientation from the person wearing the sling. This vertical orientation of the firearm allows the person to navigate narrow walkways and positions the firearm out of the way of the person wearing the sling. However, it may be cumbersome to walk with the firearm in the vertical orientation since the firearm will often extend down significantly along the person's legs.

Thus, there are times when a two-point sling is convenient and other times when a single-point sling is convenient. However, in tactical applications the person who is to wear the sling is often required to walk long distances, or repel from or climb up vertical obstacles carrying various tactical gear. Under such circumstances it is desirable for the person to travel light, making it impractical to carry both slings. But even if the person is carrying both the two-point and single-point slings, tactical operations often require the person wearing the sling to react quickly to a potential threat or a change in environment. Under such circumstances there will probably be an insufficient amount of time available for the person to change to the sling most appropriate for the given environment.

But regardless of whether a sling is a two-point or a single-point sling, conventional slings have traditionally included limited adjustment options for adjusting a length of the sling to fit people of various sizes. One such adjustment feature has typically included a strap doubled over onto itself through a slide lock adjuster. Adjusting the length of the sling using such an adjustment feature requires the person wearing the sling to remove it and manually feed a length of the material through the adjuster, followed by the second step of pulling the other portion of the material doubled over onto the newly-fed material through the adjuster. Such an adjustment is time consuming and tedious, requiring a high degree of dexterity in the person's hands. For tactical applications, a rapid adjustment may be required in less time than required for manual adjustment of a conventional slide lock adjuster through which the sling material extends and is doubled back on itself for another pass through the slide lock.

BRIEF SUMMARY

According to one aspect, the subject application involves a sling for coupling a weapon to a user of the weapon. The sling includes a strap having a length suitable to extend around at least a portion of the user when the sling couples the weapon to the user, and a weapon connector that cooperates with a fastening feature provided to the weapon to releasably couple the weapon to the strap. A first connector is coupled to the strap, as is a second connector, which is coupled to a different portion of the strap. The second connector is separated from the first connector along the sling by at least a portion of the strap. The first and second connectors cooperate to establish a connection and form a loop that extends about a portion of the user of the weapon. The sling also includes a rapid sizing adjuster coupled to the strap. The rapid sizing adjuster is adjustable by the user of the weapon to quickly establish a desired length of the sling in a single motion while the sling is coupling the weapon to the user.

According to another aspect, the subject application involves a sling for coupling a weapon to a user of the weapon. The sling includes a strap formed from a plurality strap segments and having a length suitable to extend around at least a portion of the user when the sling couples the weapon to the user. A portion of the strap supports a substantially-elastic material that is extendable to temporarily elongate the sling from an unbiased length to an elongated length in a substantially elastic manner. A first connector is coupled to the strap adjacent a first end of the strap, and a hooked connector is coupled to the strap adjacent to a second end of the strap. The hooked connector cooperates with the first connector to configure the strap into a loop that extends about the portion of the user of the weapon wearing the sling. The sling also includes a weapon connector that cooperates with a rearward connector provided to a relatively rearward portion of the weapon to couple the weapon to the sling. A coupler releasably couples the weapon connector to the strap externally of the loop, allowing the weapon connector to extend away from the loop established by cooperation between the first connector and the hooked connector. The sling also includes a rapid sizing adjuster coupled to the strap between the first and hooked connectors to adjust a length of one of the plurality of strap segments that extends between the hooked connector and the portion of the strap enclosing the substantially-elastic material. The rapid sizing adjuster includes a quick adjust buckle slidably coupled to the strap to travel along a portion of the strap, and a handle coupled to the quick adjust buckle to be grasped for adjusting the length of one of the plurality of strap segments.

The handle comprises a portion defining a portion of an aperture, the portion being separated at least one (1 in.) inch from the quick adjust buckle.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION

Figure 1:
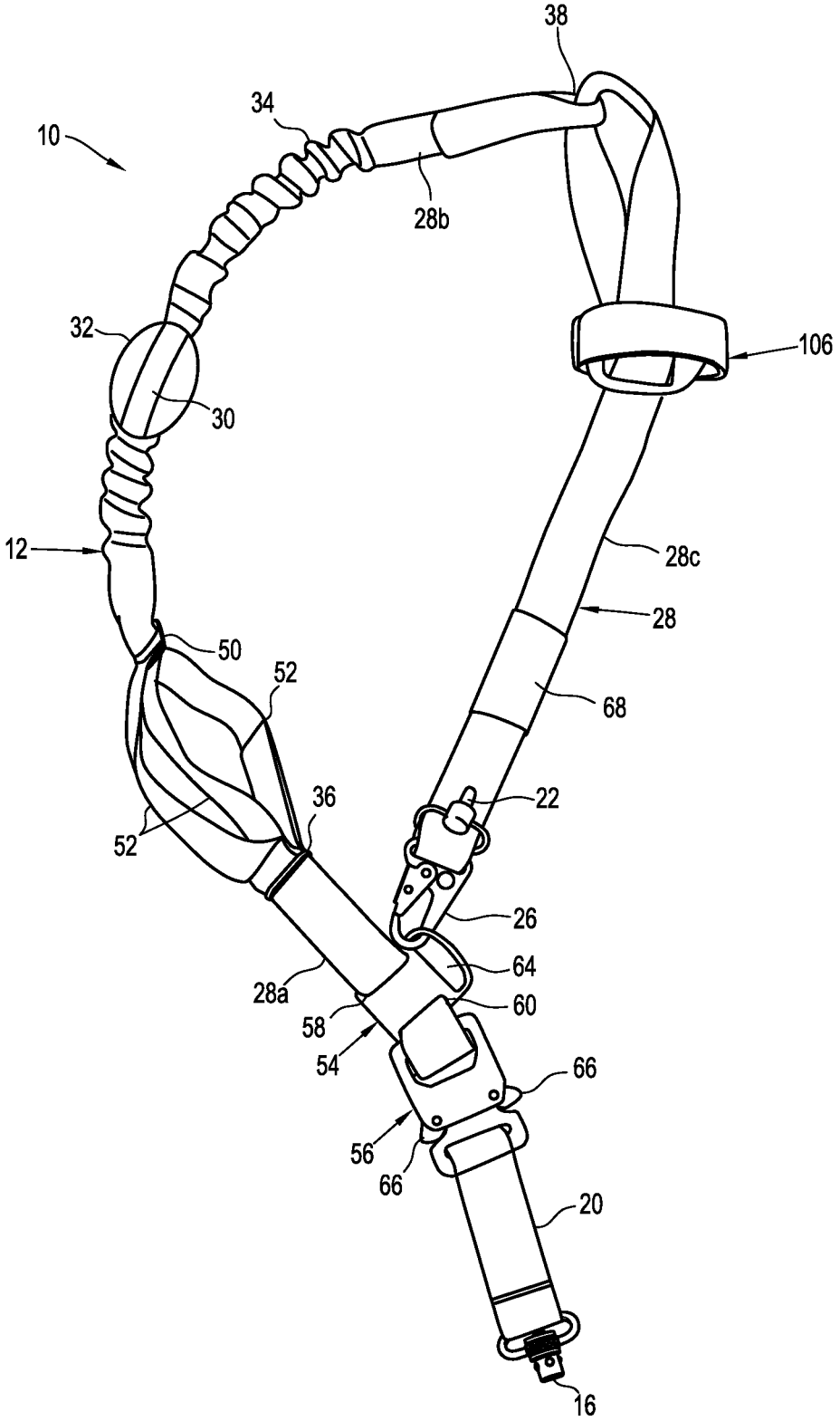
FIG. 1 shows an illustrative embodiment of a sling according to an aspect of the present technology.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

FIG. 1 shows an illustrative embodiment of a sling 10 for coupling a weapon to a user of the weapon. The weapon can be any type of weapon including long guns such as rifles, shotguns and the like, or any other elongated weapon that is desired to be suspended from the user in a plurality of different orientations. For the sake of brevity, however, and to clearly describe the sling, the illustrative embodiments set forth in detail below will describe the sling 10 as being used to suspend a rifle from the user in a single-point configuration and in a two-point configuration.

Figure 2B:
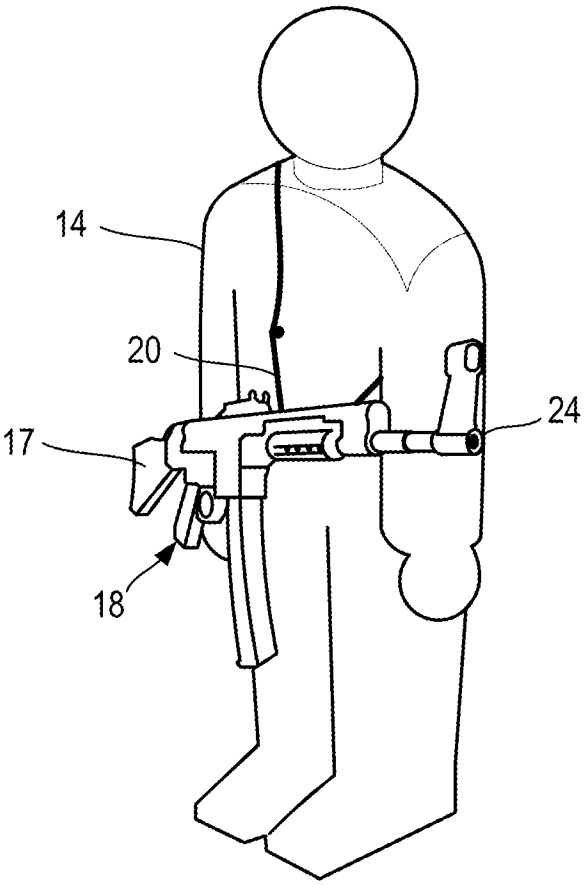
FIG. 2*b* shows a weapon coupled to a user by a sling in a two-point configuration.
Figure 2A:
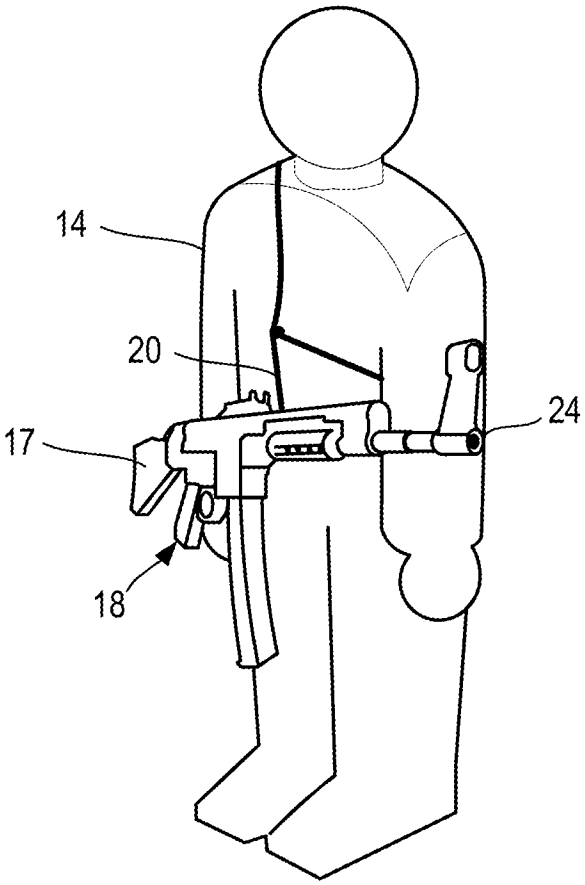
FIG. 2*a* shows a weapon coupled to a user by a sling in a single-point configuration.

In the single-point configuration, one portion of the sling 10 is coupled to another portion of the sling 10 as described below to form a loop 12 that extends around an upper torso portion of the user 14 as shown in FIG. 2*a*. An extension 20 supporting a weapon connector 16 (FIG. 1) extends in an outward direction, generally away from the loop 12 to allow the weapon connector 16 to cooperate with a compatible fastening feature provided to a relatively-rearward portion of the rifle 18 (e.g., adjacent to a stock 17 of the rifle 18). Thus, in the single-point configuration, the weapon connector 16 is the sole connection point between the rifle 18 and the sling 10. The sling 10, in the single-point configuration, allows the rifle 18 to dangle high on the user 14 from the weapon connector 16, optionally with the muzzle 24 pointed in a downward direction toward the ground.

In the two-point configuration, shown in FIG. 2*b*, the portion of the sling 10 coupled to the other portion of the sling to form the loop 12 in the single-point configuration is, instead, coupled to a relatively-forward portion of the rifle 18 (e.g., closer to the muzzle 24 than the fastening feature provided adjacent to the stock 17). A second connector, which can optionally be the same connector used to couple the portions of the sling 10 together to form the loop 12 in the single-point configuration, can optionally cooperate with a forward fastening feature provided to the rifle 18 at this relatively-forward portion of the rifle 18. In the embodiment shown in FIG. 1, this connector is a snap hook 26. According to alternate embodiments, a second weapon connector 22, different from the snap hook 26 utilized in FIG. 1 to form the loop 12, can be coupled to the snap hook 26 for cooperating with the forward fastening feature of the rifle 18. For the embodiment shown in FIG. 1, both the weapon connector 16 and the second weapon connector 22 are so-called push-button swivels described in detail below. Regardless of the connector coupled to the relatively-forward position of the rifle 18 with the sling 10 in the two-point configuration, the rifle 18 is coupled to the sling 10 at two locations, and can optionally be suspended from the user 14 in a substantially-horizontal orientation, or optionally more horizontally than when suspended via the single-point configuration.

Referring once again to FIG. 1, a strap 28 is formed from a plurality of separate strap segments 28*a*, 28*b*, 28*c* that collectively have a length suitable to extend around at least a portion of the user 14 and couple the rifle 18 to the user 14. The strap segments 28*a*, 28*b*, 28*c* can each be formed of any desired material with a sufficient tensile strength to couple the rifle 18 to the user 14 without breaking. For example, one (1 in.) inch tubular webbing made from nylon or other suitable material can be used as the strap material. According to alternate embodiments, a portion of the strap 28, such as the segment 28*b* that extends over a shoulder of the user 14 wearing the sling 10 for example, can optionally be formed from a larger dimensional tubing such as tubing having a transverse dimension of two (2 in.) inches formed from tubular nylon webbing, for example. The added size of the strap segment 28*b* can help distribute the weight of a heavy weapon over a greater area than the strap segment 28*b* formed from the one (1 in.) inch tubular nylon webbing. For such embodiments, other strap segments 28*a*, 28*c* can optionally be formed form the smaller-dimension tubular nylon webbing.

A portion of the strap 28, such as strap segment 28*b* for example, can optionally support a length of substantially-elastic material 30 (shown in the encircled region 32 where the strap material has been cut away), such as bungee cord for example. For embodiments utilizing a tubular strap material, the bungee cord or other substantially-elastic material 30 can optionally be enclosed, or partially enclosed within the tubular strap material. For such embodiments, the length of the tubular strap material enclosing the substantially-elastic material 30 can be longer than the substantially-elastic material 30 to allow the relatively non-stretchable strap material to elongate with the substantially-elastic material 30 when a tensile or other stretching force is applied to the strap segment 28. The excess tubular strap material provided to strap segment 28 is bunched up along the length of the substantially-elastic material 30, forming ripples 34 in the strap material. Such embodiments allow for temporary elongation of the strap 28 from an unbiased length to an elongated length in a substantially-elastic manner when subjected to a tensile or other stretching force.

For other embodiments, however, the substantially-elastic material 30 can optionally be disposed between two of the strap segments 28*a*, 28*b*, 28*c* or otherwise coupled to the strap 28 to allow for temporary elongation of the strap 28 from an unbiased length to an elongated length in a substantially-elastic manner when subjected to a tensile or other stretching force.

Figure 3:
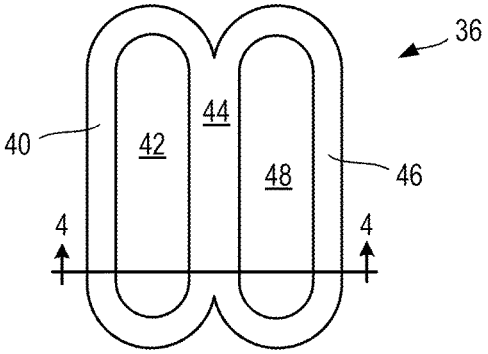
FIG. 3 shows an illustrative embodiment of a slide lock buckle that can be used as a connector between strap segments.

The strap segments 28*a*, 28*b*, 28*c* are coupled together by connectors 36, 38 that each allow the strap segments to be adjusted lengthwise (i.e., along their longitudinal axis) relative to each other. For example, the connector 36 can include a so-called "slide lock" buckle such as that shown in FIG. 3. The embodiment of the connector 36 shown in FIG. 3 allows an end of the strap segment 28*a* to be inserted through the aperture 42 and wrapped around an end leg 40 before being folded back on itself and sewn together, thereby coupling the strap segment 28*a* to the slide lock embodiment of the connector 36. The middle leg 44 and other end leg 46 of the slide lock embodiment of the connector 36 allow a plurality of passes of the strap segment to extend through the apertures 42, 48 as described below with reference to FIG. 4 to provide the sling 28 with an enhanced adjustment range with a minimal storage of excess strap material.

Figure 4:
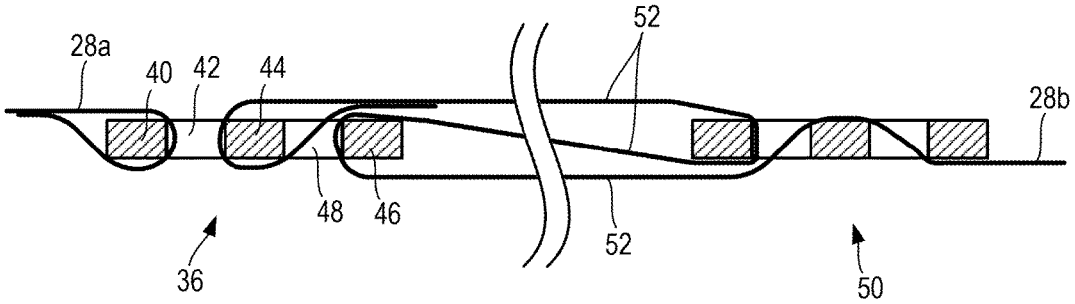
FIG. 4 shows a cross sectional view of the slide lock buckle taken along line 4-4 in FIG. 3, a similar cross-sectional view of the slide lock embodiment of the connector 50 provided to a strap segment, and multiple passes of the strap segment extending between the slide lock buckles.

A second slide lock or other suitable connector 50, shown in FIG. 1, can be provided along the length of strap segment 28*b*, such as between the portion supporting the substantially-elastic material 30 and the connector 36 for example. The connectors 36, 50 cooperate with the strap material of strap segments 28*a*, 28*b* to form an adjustment region along the sling 10 to allow for rough adjustment of the length of the strap 28 prior to deployment of the sling 10. FIG. 4 shows a cross sectional view of the slide lock embodiment of the connector 36 taken along line 4-4 in FIG. 3, and a similar cross-sectional view of the slide lock embodiment of the connector 50 appearing in FIG. 1. FIG. 4 also shows three passes 52 of the strap segment 28*b* extending between slide lock buckle embodiments of connectors 36, 50, and strap segment 28*a* coupled to slide lock connector 36. Strap segment 28*a* can be wrapped around the end leg 40 of the connector 36 and folded back onto itself, and sewn or otherwise secured in place to couple the strap segment 28*a* at a fixed length to the connector 36.

Users who wear the sling 10 in tactical situations desire to minimize the amount of freely-hanging strap material, and loops of excess strap material that allow for adjustment of the length of the strap 28. Such objects can get tangled with the rifle or other gear worn by the user, or catch on a door knob or other projection, thereby negatively affecting the mobility of the user 14. By storing strap material that has not been dispensed to contribute to the length of the strap 28 in three or more passes 52, the size of loops formed by each pass 52 can be minimized to limit the possibility that such material can extend far enough from the user and get caught on the user's gear, a door knob or other obstacle at an inopportune time.

For example, every inch of the strap material included in strap segment 28*b* that is taken in from outside the connector 50 and added to the passes can be divided equally amongst the passes. Thus, to remove that inch of strap material from the length of strap segment 28*b*, the distance between the connectors 36, 50 spanned by the passes 52 increases only one-third (⅓ in.) of an inch. Thus, by employing at least three (3) passes between the connectors 36, 50, the passes 52 remain reasonably sized, thereby minimizing the possibility that the passes 52 will get caught on an obstacle and interfere with the user's mobility. Further, enough strap material can be distributed amongst the passes 52 to provide the sling 10 with a suitable adjustment range.

Figure 5:
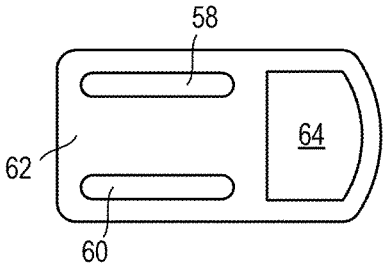
FIG. 5 shows an illustrative embodiment of a first connector including two apertures formed in a metallic plate for coupling the metallic plate to a strap, and a generally D-shaped aperture for cooperating with a second connector to establish a loop configuration of the strap.

To facilitate conversion of the sling 10 between single and two-point configurations, a first connector 54 is shown in FIG. 1 coupled to the strap segment 28*a* adjacent a first end if the strap 28. For the embodiment show, the strap segment 28*a* is coupled to the connector 36 at one end and to a coupler 56 at an opposite end. The embodiment of the first connector 54 shown in FIG. 5 includes two apertures 58, 60 formed in a metallic plate 62, which also defines a generally D-shaped aperture 64. It is to be understood that the generally D-shape of the aperture 64 is described merely as an example, and that the aperture 64 can be of any shape allowing cooperation with the snap hook 26 or other suitable connector to form the strap 28 into a loop 12. Further, although describes as being metallic, the metallic plate 62 can be formed from any suitably durable material, including but not limited to plastics and polymeric materials, metals and metal alloys, and the like. The metallic plate 62 can optionally be substantially planar, including relatively large primary surfaces with greater surface area than minor surfaces forming the edge of the metallic plate 62 in a depth direction. As shown, the D-shaped aperture 64 can be disposed at one lateral-end of the metallic plate 62, substantially in a common plane with the metallic plate 62, allowing the first connector 54 to rest flat against the user wearing the sling 10. Further, for such embodiments, the D-shaped aperture 64 remains in a substantially constant position known to the user, allowing ready conversion of the sling 10 between single and two-point configurations. Alternate embodiments of the first connector 54 can include a D-shaped aperture 64 formed at both lateral ends of the metallic plate 62 to create an ambidextrous sling 10, or provided solely to the opposite end from that shown with the D-shaped aperture 64 in FIG. 5 to create a left handed sling 10.

The strap segment 28*a* can extend through both apertures 58, 60 of the metallic plate 62 to couple the first connector 54 to the strap segment 28*a*, terminating in the coupler 56 that releasably couples the weapon connector 16 to the strap 28. For the embodiment shown in FIG. 1, the coupler includes a plurality of independent release mechanisms 66, shown as levers, that each require manual manipulation, and optionally simultaneous manipulation, to release the weapon connector 16 from the strap 28, and accordingly, the sling 10. Each of the release mechanisms 66 can optionally be spring biased toward a position at which the release mechanisms 66 retain the weapon connector 16 as part of the sling 10. Thus, if one release mechanism is inadvertently manipulated, it is unlikely that both can be simultaneously manipulated, resulting in separation of the weapon connector 16 from the sling 10.

The levers forming the release mechanisms 66 in the embodiment shown in FIG. 1 can be operatively connected to one or more latches. Manipulating the release mechanisms 66 away from their retaining positions can open the latch, thereby releasing the weapon connector 16. Further, the embodiment of the coupler 56 in FIG. 1 includes an all-metal construction to provide the sling with added durability and resistance to wear from the elements that may not be afforded by lesser materials. However, alternate embodiments include a coupler 56 made of materials other than metal, such as a plastic Classic SR Dual Adjust buckle offered by ITW Nexus, for example.

The snap hook 26 or other connector employed as a second connector is coupled to the strap 28 adjacent to a second end of the strap 28. The snap hook 26 is compatible to cooperate with an anchor point such as a metallic loop or other suitable anchor point at the relatively forward portion of the rifle 18. Further, the snap hook 26 is also compatible to clip onto the portion of the first connector 54 defining a portion of the D-shaped aperture 64 or other connection feature to configure the strap into a loop 12 that extends about the portion of the user wearing the sling 10. Thus, the snap hook 26 can optionally be interchangeably connected to both the fastening feature of the rifle 18 and the first connector 54. For such embodiments, if compatibility with different anchor points possibly provided to the rifle is not a concern, the snap hook 26 may thus be both the second connector for establish the looped configuration of the strap 28 and the second weapon connector 22. In other words, only the snap hook 26 need be coupled adjacent the other end of the strap 28 opposite the end provided with the first connector 54.

According to alternate embodiments, the rifle 18 may be provided with a fastening feature that is not compatible with the snap hook 26 to establish the two-point configuration. However, to retain the ability to establish the loop configuration of the strap 28, the snap hook 26 may again be coupled adjacent to the end of the strap 28 opposite the end provided with the first connector 54. For the alternate embodiments, however, the second weapon connector 22, other than a snap hook 26, can also be coupled adjacent to the end of the strap 28 opposite the end with the first connector 54.

This second weapon connector 22 can be coupled to the strap 28 adjacent the snap hook 26. Positioned as such, there is a possibility that the snap hook 26 and second weapon connector 22 can make contact with each other, thereby emitting possibly unwanted noises that could potentially give away the position of the user wearing the sling 10. Again, in tactical situations, such noises can affect the ability of the user to navigate an area undetected. To minimize noises from contact between the snap hook 26 and the second weapon connector 22, a silencer 68 can be provided to interfere with the ability of the snap hook 26 and second weapon connector 22 to make contact and emit unwanted noises as a result. For example, one embodiment of the silencer 68 can include an adjustable sleeve formed from a material with a degree of elasticity that allows the sleeve to be slid over at least one of the snap hook 26 and the second weapon connector 22. According to alternate embodiments, the sleeve can be slid along the strap segment 28*c* over the one of the snap hook 26 and the second weapon connector 22 that is not in use to couple the strap segment 28*c* to another object such as the first connector 54 or the rifle 18. The sleeve, once in place, holds and maintains a position of at least one of the second weapon connector 22 and the snap hook 26 relative to each other to minimize contact between the two.

Figure 6:
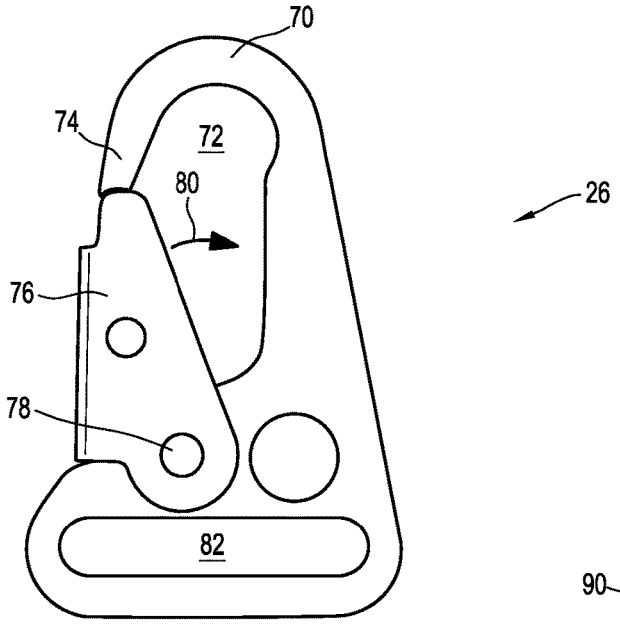
FIG. 6 shows an illustrative embodiment of a second connector in the form of a snap hook.

Each of the weapon connectors 16, 22 can be independently selected to be compatible with the rifle to be used with the sling 10. However, specific examples of connectors that can be used as the weapon connector include, but are not limited to: a push button swivel, a snap hook, and a mash hook. The snap hook, such as snap hook 26 appearing in FIG. 6 and describe above as the second connector, includes a hooked portion 70 that partially defines an aperture 72 and clips onto the portion of the metallic plate 62 defining the D-shaped aperture 64, for example, or any other compatible fastening feature. A leading end 74 of the snap hook 26 extends into the D-shaped aperture 64 when the hooked portion 70 is in place to cooperate with the first connector 54. A spring-biased gate 76 is coupled to rotate about a pivot pin 78, and biased toward the closed position by a spring. To disconnect the snap hook 26 from the first connector 54, for example, the gate 76 is urged inward in the direction of arrow 80 to pivot about the pivot pin 78, thereby opening the aperture 72 for removal of the snap hook 26 from the first connector 54. The strap material of the strap segment 28*c* can be extended through an elongated transverse aperture 82, folded back onto itself and sewn in place to couple the snap hook 26 to the strap segment 28*c*.

Figure 7:
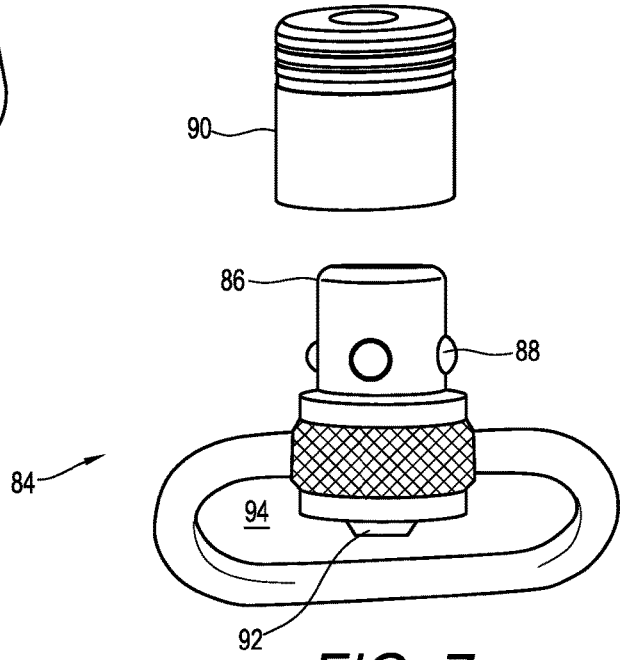
FIG. 7 shows an illustrative embodiment of a second connector in the form of a push button swivel.

An illustrative embodiment of a push button swivel 84 is shown in FIG. 7. The push button swivel 84 includes a metallic, tubular barrel 86 from which four, or other number of cams 88, protrude. The cams 88 are urged outwardly from within the barrel 86 in their natural state. To couple and remove the push button swivel 84 to and from the compatible fastening feature 90 provided to the rifle 18, a button 92 is manually pressed to relieve the outward-biasing force on the cams 88, allowing them to be at least partially retracted into the barrel 86 a sufficient distance to allow the barrel 86 to enter/exit the fastening feature 90. With the barrel 86 inserted into the fastening feature 90, the button can be released, once again restoring the biasing force on the cams 88, holding the push button swivel 84 in place. Similar to the snap hook 26, an elongated, transverse aperture 94 facilitates connection of the push button swivel 84 to the strap material.

Figure 8:
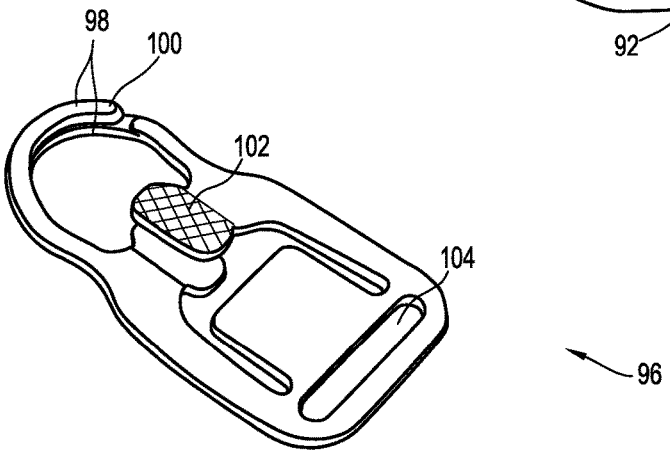
FIG. 8 shows an illustrative embodiment of a second connector in the form of a mash hook.

An illustrative embodiment of a mash hook 96 weapon connector is shown in FIG. 8. Like the snap hook 26, the mash hook 96 also includes a hooked portion 98 with a leading end 100 that extends into an aperture of a compatible fastening feature. Unlike the snap hook 26, however, the mash hook 96 includes opposing hooked portions 98 that together interfere with inadvertent removal of the mash hook 96 from the weapon instead of the gate 76. To connect and remove the mash hook 96, the opposing hooks are separated by pressing on handles 102 and one of the hooked portions 98 is clipped onto the fastening feature, then the handles 102 are released. Similar to the snap hook 26, an elongated, transverse aperture 104 facilitates connection of the mash hook 96 to the strap material.

Referring once again to FIG. 1, the sling 10 also includes a rapid sizing adjuster 106 coupled along the strap 28 between the first and second connectors 54, 26 to adjust a length of one of the plurality of strap segments 28*a*, 28*b*, 28*c* extending between the snap hook 26 and the portion of the strap 28 supporting the substantially-elastic material. References made herein to along the strap indicate that an object considered to be between two other objects "along the strap" is in between when viewed by their positions coupled to the strap. The object does not necessarily have to simply be physically in between the two other objects. The rapid sizing adjuster 106 is adjustable by the user 14 while wearing the sling 10 to quickly establish a desired length of the strap 28 in a single motion, while the sling 10 is coupling the rifle 18 to the user 14.

Figure 9:
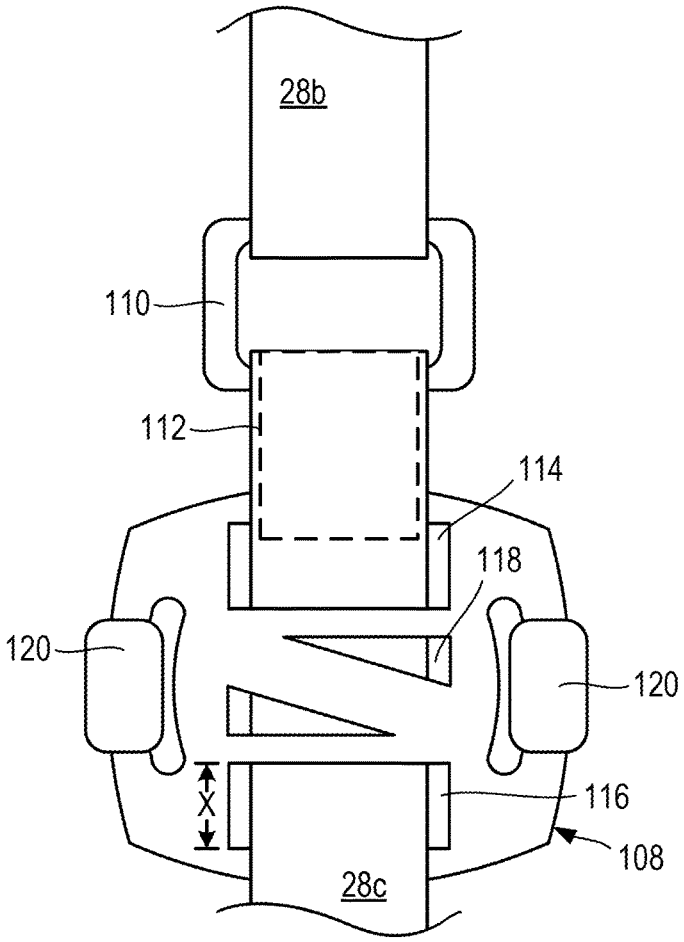
FIG. 9 shows a bottom view of an illustrative embodiment of a quick adjust buckle included as part of a rapid sizing adjuster.

During adjustment, a quick adjust buckle 108, shown in FIG. 9 and included as part of the rapid sizing adjuster 106, is slid along a portion of the strap segment 28*c*. Strap segment 28*c* is coupled to strap segment 28*b* using a loop lock 110 or other suitable coupling. A portion 112 (shown in FIG. 1 and as hidden lines in FIG. 9) of strap segment 28*c* pulled through the loop lock 110, extends through an aperture 116 (FIG. 9) formed in the quick adjust buckle 108 to be folded back onto itself and sewn in place, thereby coupling the end of the portion 112 to the quick adjust buckle 108. The other end of the portion 112 leading toward the snap hook 26 or other form of second connector along the strap segment 28*c* extends through the loop lock 110, extends upwardly through aperture 114 and back down through aperture 116, from where it continues on to the snap hook 26 and optional additional weapon connector 22. Each aperture 114, 116 can be any suitable size to permit the quick adjust buckle 108 to be slid along the strap segment 28*c*. According to an illustrative embodiment, each of the apertures 114, 116 is at least one half (½ in.) of an inch in a dimension X. Additional apertures 118 can optionally be formed in the quick adjust buckle 108 to minimize the weight of the quick adjust buckle 108 and, accordingly, the overall weight of the sling 10.

Figure 10:
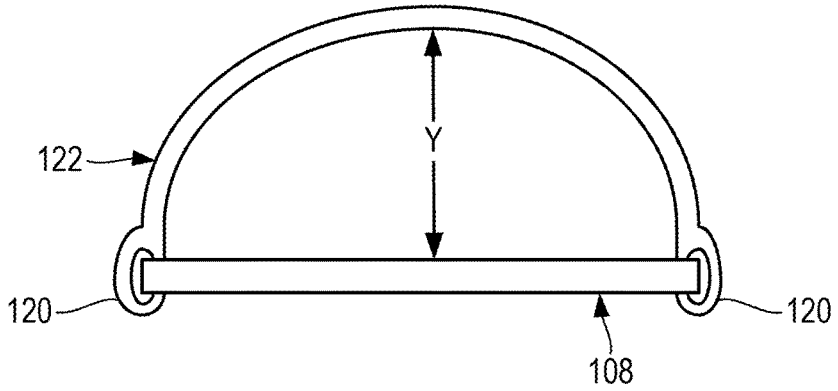
FIG. 10 shows an end view of a quick adjust buckle and handle.

Ends 120 of a handle 122 (FIGS. 1 and 10) formed from a flexible material such as the strap material, for example, can extend through apertures 124 formed in the quick adjust buckle 108 to couple the handle 122 to the quick adjust buckle 108. The handle can optionally include a plurality of passes of the strap material to provide the handle 122 with a sufficient degree of rigidity to substantially maintain an unbiased shape of the handle 122, positioning a portion of the handle at least one (1 in.) from the quick adjust buckle 108. When viewed on end as in FIG. 10, the Y dimension separating the underside of the handle 122 from the surface of the quick adjust buckle 108, the Y dimension being normal to the surface of the quick adjust buckle 108, is at least one (1 in.) inch according to one embodiment, or at least one and one half (1½ in.) inches according to another embodiment, or at least two (2 in.) inches according to another embodiment. Suitably sized, the handle 122 can be grasped with a single hand by the user 14 while wearing the sling 10 coupled to the rifle 18, even while wearing gloves, to adjust, in a single motion, the length of the strap segment 28*c* and, accordingly, the length of the strap 28.

The snap hook 26 will be considered to be the second connector for the following example, but as mentioned above, the second connector is not so limited. As the quick adjust buckle 108 is slid along the strap segment 28*c* toward the snap hook 26 to shorten distance separating the loop lock 110 and the snap hook 26, the portion 112 of the strap segment 28*c* between the quick adjust buckle 108 and loop lock 110 is lengthened, and the other portion of the strap segment 28*c* separating the snap hook 26 and the loop lock 110 is shortened, thereby shortening the length of the strap 28. Despite shortening the distance between the snap hook 26 and loop lock 110, however, the excess strap material is taken up as the portion 112 that is coupled to the quick adjust buckle 108. Thus, even when the strap segment 28*c* is shortened, a free end of the strap segment 28*c* is not left to hang freely, posing a threat to get tangled in the rifle 18 or other gear worn by the user 14.

Adjusting the quick adjust buckle 108 in the other direction along the strap segment 28*c*, the distance between the loop lock 110 and the snap hook 26 approaches its smallest dimension as the length of the portion 112 of the strap segment 28*c* pulled through the loop lock 110 approaches the length of the portion of the strap segment 28*c* extending between the loop lock 110 and the snap hook 26. If the snap hook 26 defines a limit of the distance the quick adjust buckle 108 can be pulled in this direction along the strap segment 28*c*, then the shortest distance along the strap segment 28*c* between the loop lock 110 and the snap hook 26 occurs when the portion 112 of the strap segment 28*c* is approximately equal in length to the portion of the strap segment 28*c* separating the loop lock 110 from the snap hook 26. In contrast, the length of the portion of the strap segment 28*c* extending between the loop lock 110 and the snap hook 26 approaches its greatest length as the length of the portion 112 of the strap segment 28*c* pulled through the loop lock 110 approaches its shortest length.

According to embodiments of the invention, a plurality of, or all of the connectors provided to the sling 10, including but not limited to the weapon connector 16; second weapon connector 22; snap hook 26 or other second connector; connectors 36, 38; slide lock connector 50; first connector 54; coupler 56, loop lock 110, and quick adjust buckle 108, can be formed from a metal, metal alloy, or similarly durable material.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A sling for coupling a weapon to a user of the weapon, the sling comprising:

a strap having a length suitable to extend around at least a portion of the user when the sling couples the weapon to the user;

a weapon connector that cooperates with a fastening feature provided to the weapon to releasably couple the weapon to the strap;

a first connector coupled to the strap, the first connector comprising a substantially planar region and a connector portion that extends from the substantially planar region in a common plane with the substantially planar region, wherein the substantially planar region comprises a plurality of apertures to allow a portion of the strap to pass through, the substantially planar region has a primary surface that faces the user wearing the sling, and the connector portion at least partially defines an aperture;

a second connector coupled to a different portion of the strap and separated from the first connector along the sling by at least a portion of the strap, wherein the first and second connectors cooperate to establish a connection and form a loop that extends about a portion of the user of the weapon; and a rapid sizing adjuster coupled to the strap, the rapid sizing adjuster being adjustable by the user of the weapon to quickly establish a desired length of the sling in a single motion while the sling is coupling the weapon to the user.

2. The sling of claim 1, wherein the strap comprises a generally-tubular portion that encloses a substantially-elastic material that is extendable to temporarily elongate a length of the sling in a substantially elastic manner.

3. The sling of claim 2, wherein a length of the generally-tubular portion enclosing the substantially-elastic material is greater than a length of the substantially-elastic material.

4. The sling of claim 2, wherein the generally-tubular portion is arranged along the sling to extend over an upper torso of the user while coupling the weapon to the user, and the generally-tubular portion comprises a transverse dimension of approximately two (2 in.) inches.

5. The sling of claim 1, wherein the second connector comprises a snap hook that clips onto the first connector to complete the loop, and wherein the snap hook is removable from the first connector and is compatible with an anchor point provided to the weapon to convert the sling from a single-point configuration to a multi-point configuration.

6. The sling of claim 1, wherein the second connector is compatible with both a fastening feature provided to the weapon and the first connector, wherein the second connector cooperates with the fastening feature to couple the sling to the weapon in a multi-point configuration and cooperates with the first connector to complete the loop in the single-point configuration.

7. The sling of claim 1, wherein the weapon connector is releasably coupled to the strap by a coupler comprising a plurality of independent release mechanisms that each require manual manipulation to release the weapon connector from the sling.

8. The sling of claim 1 further comprising a second weapon connector adjacent to the second connector, wherein the second weapon connector is different from the second connector.

9. The sling of claim 8, wherein at least one of the weapon connector and the second weapon connector is selected from the group consisting of: a push button swivel, a snap hook, and a mash hook.

10. The sling of claim 8, wherein the second weapon connector is provided sufficiently close to the second connector to make contact with the second connector, the sling further comprising a silencer that minimizes a sound emitted as a result of said contact between the second weapon connector and the second connector.

11. The sling of claim 10, wherein the silencer comprises an adjustable sleeve formed from a substantially-elastic material that can be slid at least partially over one or both of the second weapon connector and the second weapon connector to substantially maintain a position of at least one of the second weapon connector and the second connector to minimize the contact between the second weapon connector and the second connector contact.

12. The sling of claim 1, wherein the rapid sizing adjuster comprises:

a quick adjust buckle slidably coupled to travel along a portion of the strap, wherein the quick adjust buckle comprises an aperture through which the portion of the strap travels during adjustment of the rapid sizing adjuster to establish the desired length of the sling; and a handle coupled to the quick adjust buckle, wherein the handle, when pulled by a single hand of the user while wearing the sling adjusts a position of the quick adjust buckle along the portion of the strap to adjust the length of the sling.

13. The sling of claim 12, wherein the quick adjust buckle is coupled adjacent to one end of the portion of the strap, the second connector is coupled adjacent to an opposite end of the strap, and the portion of the strap extends through an aperture defined by the quick adjust buckle.

14. The sling of claim 12, wherein the handle comprises a flexible material coupled to the quick adjust buckle to define an aperture between the length of flexible material and the quick adjust buckle.

15. The sling of claim 14, wherein the flexible material comprises a rigidity that substantially maintains an unbiased shape positioning a portion of the handle at least one (1 in.) from the quick adjust buckle.

16. The sling of claim 14, wherein the flexible material coupled to the quick adjust buckle extends transversely across the quick adjust buckle relative to a direction in which the quick adjust buckle travels along the portion of the strap during adjustment.

17. The sling of claim 1 further comprising a second length adjustment region between the first and second connectors, the second length adjustment region comprising a first adjustment buckle adjacent one end of the length adjustment region, and a second adjustment buckle adjacent an opposite end of the length adjustment region relative to the first adjustment buckle, wherein at least three passes of the strap extend between the first and second adjustment buckles.

18. The sling of claim 17, wherein the first and second adjustment buckles comprise slip lock buckles.

* * * * *